United States Patent [19]

Harless

[11] Patent Number: 4,723,293

[45] Date of Patent: Feb. 2, 1988

[54] HEARING AID APPARATUS

[75] Inventor: Friedrich Harless, Nuremberg, Fed. Rep. of Germany

[73] Assignee: Siemens Aktiengesellschaft, Berlin and Munich, Fed. Rep. of Germany

[21] Appl. No.: 617,549

[22] Filed: Jun. 5, 1984

[30] Foreign Application Priority Data

Jul. 1, 1983 [DE] Fed. Rep. of Germany ..... 3323788

[51] Int. Cl.[4] ..... H04R 25/00; H04R 25/02

[52] U.S. Cl. ..... 381/68; 381/68.7

[58] Field of Search ..... 179/107 R, 107 E, 107 H; 381/68, 69, 68.1–68.7; 181/129, 130

[56] References Cited

U.S. PATENT DOCUMENTS

| | | | |
|---|---|---|---|
| 2,904,640 | 9/1959 | Dreher et al. | 381/117 |
| 3,659,056 | 4/1972 | Morrison et al. | 381/68 |
| 3,742,359 | 6/1973 | Behymer | 381/69 |
| 3,819,860 | 6/1974 | Miller | 381/169 |
| 4,137,431 | 1/1979 | Pallesen | 381/68.7 |

FOREIGN PATENT DOCUMENTS

| | | | |
|---|---|---|---|
| 2049883 | 4/1972 | Fed. Rep. of Germany . | |
| 2552475 | 5/1977 | Fed. Rep. of Germany | 179/107 R |
| 3006365 | 11/1980 | Fed. Rep. of Germany . | |
| 3431584 | 3/1986 | Fed. Rep. of Germany | 381/68 |

*Primary Examiner*—Thomas W. Brown
*Assistant Examiner*—Danita R. Byrd
*Attorney, Agent, or Firm*—Hill, Van Santen, Steadman & Simpson

[57] ABSTRACT

A hearing aid apparatus has a housing containing components such as a microphone, an amplifier and an earphone,and to which a terminal having contacts for connection to a signal line is applied. The terminal also has contacts for derivation of signals from the microphone so that a conventionally operating hearing aid is achieved which also contains an audio output in addition to an audio input. The hearing aid apparatus is thus particularly suitable for use as a talk/listen set in aural training systems.

7 Claims, 5 Drawing Figures

HEARING AID APPARATUS

BACKGROUND OF THE INVENTION

1. Field of the Invention

The present invention relates to a hearing aid apparatus, and in particular to a hearing aid apparatus adapted for use in aural training systems.

2. Description of the Prior Art

In conventional hearing aid devices such as described, for example, in U.S. Pat. No. 4,137,431, terminals for electrical signals are employed for the introduction of signals from an external microphone, such as an external microphone in a telephone handset or a microphone which is part of an aural training apparatus. Audio signals from other signal generators such as radio and television receivers may also be directly introduced into the hearing aid apparatus by means of such leads.

If the hearing aid apparatus is connected to an aural training apparatus, however, it is still necessary to utilize a separate microphone for picking up the speech of the other students in the room with the user. In conventional systems, this is accomplished by station amplifiers installed at each trainee station. This requires a rather complicated network which must be provided for every trainee station.

SUMMARY OF THE INVENTION

It is an object of the present invention to provide a hearing aid apparatus for use in an aural training system which permits the station amplifiers to be significantly simplified.

The above object is inventively achieved in a hearing aid apparatus having a housing containing the essential parts of the device, such as a microphone, an amplifier or amplifiers, and a receiver, and to which a terminal having contacts for connection to a signal feed to the receiver (audio input) is applied, and wherein the terminal also includes contacts for deriving a signal from the microphone (audio output).

The station amplifier, which is part of a classroom amplifier system, required in conventional aural training systems can be significantly simplified by the use of a hearing aid constructed in accordance with the principles of the present invention having a terminal for deriving signals from the microphone, that is, an audio output. Except for a microphone amplifier with a trainee speaking key, all other components required in conventional station amplifiers can be eliminated. Except for the matching or adjustment of different microphone levels or volumes, all other functions of traditional station amplifiers are assumed by the hearing aid disclosed herein. Moreover, a listen/speak set (combination receiver and microphone) is not required at the trainee stations when the hearing aid disclosed herein is utilized.

Depending upon the format of the hearing aid means employed, the amplifier for the microphone may also be replaced by the hearing aid amplifier. Given transfer of the trainee speaking key for switching on the respective hearing aid microphone from the training system into the connecting line to the hearing aid, the only portion of the equipment found in a conventional trainee station still needed is the actual connection or reception coupling. A significant reduction in outlay in comparision with conventional systems is thus achieved.

DESCRIPTION OF THE PREFERRED EMBODIMENTS

Figure 1:
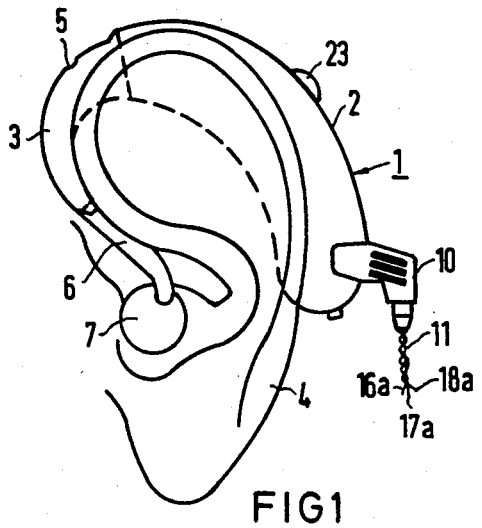
FIG. 1 is a side view of a hearing aid constructed in accordance with the principles of the present invention shown worn behind the ear.

A hearing aid apparatus 1 constructed in accordance with the principles of the present invention is shown in FIG. 1 having a housing 2 containing the electrical components of the hearing aid which is worn over the upper apophysis of an ear 4 by means of a crook 3. The apparatus functions in the conventional manner in that sound which is admitted through an opening 5 is amplified by a circuit such as shown in FIG. 4 and is supplied to the interior ear of the user by a sound-conducting conduit 6 which is anchored in the ear canal by an earpiece 7.

Figure 3:
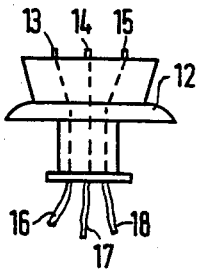
FIG. 3 is a side view of a terminal contact piece for the hearing aid shown in FIGS. 1 and 2.
Figure 2:
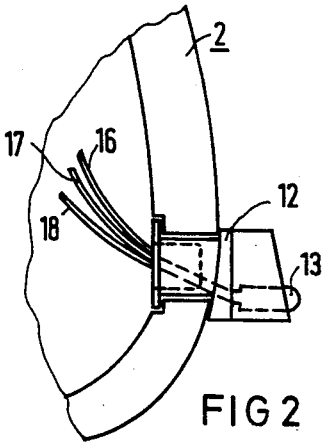
FIG. 2 is an enlarged view of the portion of the housing of the hearing aid shown in FIG. 1 at which the terminal contacts are attached.

Signals to be reproduced may also be supplied to the apparatus 1 via a terminal 10 in addition to via the opening 5. These signals are picked up, for example, by a microphone 47 (shown in FIG. 5) which is part of an aural training system. Feed of the signals occurs via a line 11. For the purpose of making the actual connections, the apparatus 1 has a connector 12 (shown in detail in FIG. 3) at which contacts 13, 14 and 15 are situated. Signal feed lines 16, 17 and 18 (as well as lines **16*b* and 17*b* shown in FIG. 4) are connected to the contacts 13 through 15 as well as to contacts 13*a* and 14*a* disposed in the interior of the apparatus 1, these lines representing the actual connections to the components 20 through 24 of the circuit of the hearing apparatus 1. The contact line 18, connected to 15, is a common line for signals proceeding to the receiver 20 and which are derived from the microphone 21. The line 17 is the actual signal line for the signal feed, that is, the audio input, and the line 16** is the line for derivation of the audio signal, that is, the audio output.

As stated above, the connector 12 has three contacts 13, 14 and 15 which are respectively connected through the connector 12 to lead lines 16, 17 and 18. The lines 16, 17 and 18 are shown in FIG. 4, those lines each terminating in respective connectors 13, 14 and 15, also shown in FIG. 4. Alternatively, the signal from the microphone 21 can be tapped after the preamplifier **22*a* at line 16*b*, terminating in contact 13*a*, instead of before the preamplifier 22*a* at line 16. Similarly, the incoming audio signal can be supplied via line 17*b*, terminating in contact 14*a*, instead of via line 17 terminating in contact 14, in which case the preamplifier 22*a* is bypassed. Even if these alternative connections are utilized, the structure of the connector shown in FIG. 3 does not change, only the places at which the lines 16, 17 and 18 are connected to the circuit as shown in FIG. 4. The external 3-lead twisted cable 11 consists of lines 16***a*, 17*a* and 18*a* respectively connected to the terminals 13, 14 and 15. Since these are external lines, they are referenced differently than the internal lines 16, 17 and 18. These lines are also schematically shown in FIG. 5.

Figure 4:
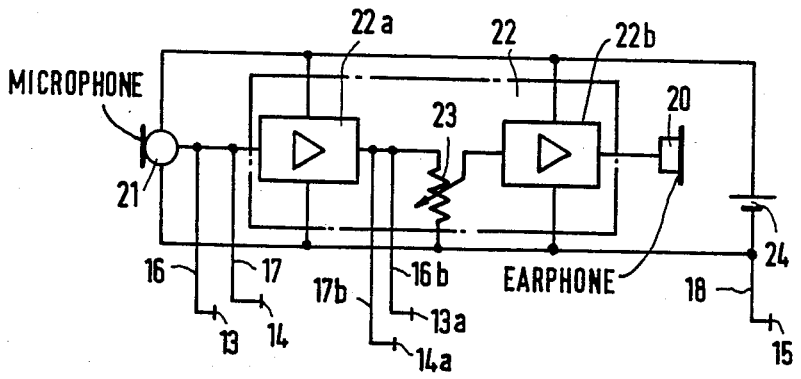
FIG. 4 is a schematic circuit diagram showing the circuit components and the terminal contacts in a hearing aid constructed in accordance with the principles of the present invention.

The circuitry for the apparatus 1 is shown in FIG. 4 comprising a microphone 21, an amplifier 22 with a preamplifier 22*a*, a volume control means 23, a final amplifier 23*a*, and a receiver 20. These individual components are of conventional design, with energy being supplied from a current source 24, for example a miniature battery. A signal registered in the microphone 21 can be tapped between the contacts 13 and 15 or between the contacts 13*a* and 15, depending upon the wiring of the circuitry. Depending upon the purpose for which the apparatus 1 is to be used, tapping before or after the preamplifier 22 may be preferred, for example, for preventing crosstalk which may occur, or for matching the output power to the different cable capacitances of the system. The amplifier 22 functions as a linear amplifier without influencing signal frequency, and generally without influencing signal dynamics.

In the same manner by which tapping of the signal may be undertaken between the contacts 13 and 15 of the circuit or between 13*a* and 15, it is also possible to feed the incoming signal audio through the online 17 entire amplifier 22 by connection between contacts 14 and 15, or alternatively only through the volume control 23 and the final amplifier 22b by means of connection between terminals 14*a* and 15 (in which case the signal feed occurs via line 17*b* connected to terminal 14*a*). Matching to given conditions may also be achieved by suitable selection of the connection location.

Figure 5:
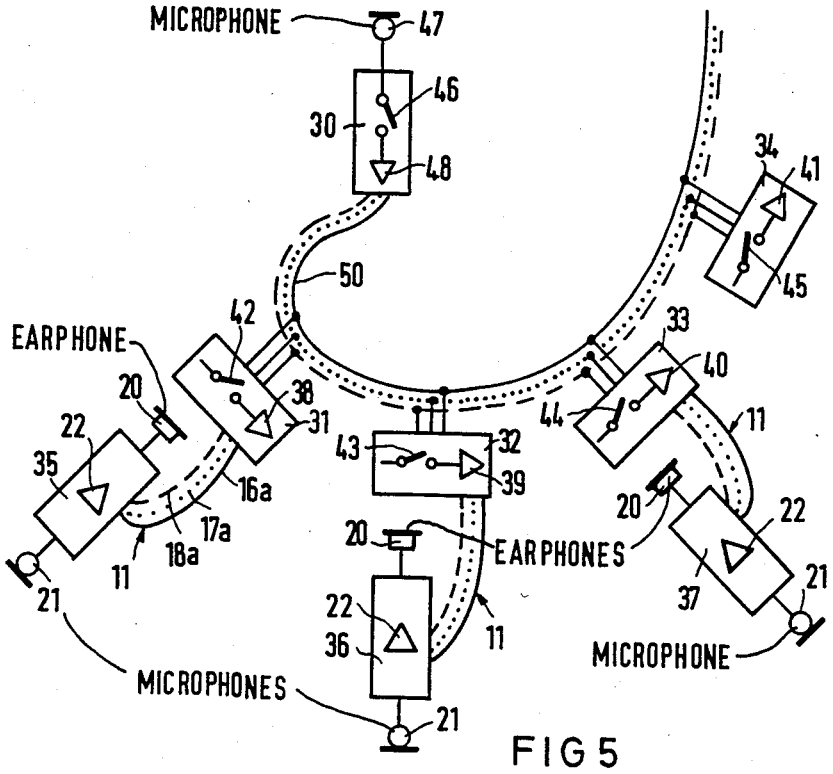
FIG. 5 is a schematic block diagram of an oral training system employing a number of hearing aids constructed in accordance with the principles of the present invention.

A typical aural training system employing hearing aid devices constructed in accordance with the principles of the present invention is shown in FIG. 5. The station 30 is the instructor station for the training system. Trainee stations 31, 32, 33 and 34 are shown connected thereto by a three line cable. Hearing aid devices 35, 36 and 37 constructed in accordance with the principles of the present invention are respectively connected to the trainee stations 31, 32 and 33. The trainee station 34 is unoccupied. The trainee stations 31 through 34 have respective station amplifiers 38, 39, 40 and 41 as well as respective push button switches 42, 43, 44 and 45 operating as a speaking key. A corresponding key 46 is also interconnected between the instructor microphone 47 and the instructor station amplifier 48. Whereas the line 50 to the trainee stations 31 through 34 is permanently wired, the individual connection lines 11 between the trainee stations 31 through 33 and the respective hearing aid devices 35 through 37 are detachable plug-in lines. Thus connection of lines 16, 17 and 18 of each hearing aid device can be undertaken via the three leads 16*a*, 17*a* and 18*a* of the line 11 through the terminal 10 to the trainee stations 31 through 34 and to the instructor station 30.

The general function of the training system shown in FIG. 5 is the same as for conventional training systems. The main structural difference, however, is that the hearing aid devices 35 through 37 constructed in accordance with the principles of the present invention are employed instead of conventional listen/talk sets, each comprising an earphone and a microphone. As a result, listening can be optimally adjusted by each user by means of individual adjustment of the user's hearing apparatus 1 and additional microphones need not be employed because the microphones 21 of the trainees and the instructor microphone 47 suffice for the entire system. When one of the participants wishes to speak in a conversation being conducted using the system, he or she presses his or her speaking key and thus closes one of the switches 42 through 46. The respective microphone 21 (or the instructor microphone 47) is then activated by the amplifiers 22 in the apparatus (or the amplifiers 38 through 41 or 48) so that a signal proceeds via the line 18*a* to the respective earphone 20 of a trainee hearing apparatus 1.

Although modifications and changes may be suggested by those skilled in the art it is the intention of the inventor to embody within the patent warrnted hereon all changes and modifications as reasonably and properly come within the scope of his contribution to the art.

I claim as my invention:

1. In a hearing aid apparatus for use in an aural training system having a housing for being worn outside an ear canal of a user's ear, said housing containing a microphone, at least one amplifier, and receiver, and having a terminal with contacts for connection to a signal feed to the receiver, the improvement comprising additional contacts located at said terminal for deriving a signal from said microphone inside said housing, said microphone signal being routed through said amplifier to said terminal.

2. A hearing aid apparatus as claimed in claim 1 wherein said terminal is connected to an aural training apparatus for use of said hearing apparatus as a listen/-talk set in said system.

3. A hearing aid apparatus for use in an aural training system comprising:

a housing containing a microphone, an amplifier, and an electrical output;

means for securing said housing on a user's ear outside the ear canal;

means for deriving a signal from said microphone inside said housing; and means for routing said signal through said amplifier to said electrical output of said housing.

4. A hearing aid apparatus as claimed in claim 3, wherein said housing further includes a receiver with contacts at said electrical output for connection to a signal feed to the receiver.

5. A hearing aid apparatus as claimed in claim 4, further comprising:

an earpiece receivable in the ear canal; and a sound conducting conduit connecting said earphone inside said housing to said ear canal of a user through said earpiece.

6. A hearing aid apparatus for use in an aural training system comprising:

a housing containing a microphone, an amplifier, receiver, and a terminal with first contacts for connection to a signal feed to the receiver and said terminal having a second contact;

means for securing said housing on a user's ear outside the ear canal;

an earpiece receivable in the ear canal;

a sound-conducting conduit for connecting said receiver inside said housing with the ear canal of the user's ear through said earpiece;

means for deriving a signal from said microphone inside said housing; and means for routing said signal through said amplifier to said second contact of said terminal.

7. A hearing aid comprising:

a housing having an opening;

a microphone contained in said housing for receiving audio signals from an exterior of said housing admitted through said opening;

at least one amplifier connected to said microphone for amplifying the signal therefrom, said amplifier disposed in said housing;

a receiver to be worn in a user's ear including a sound-conducting conduit and an ear mold; and a connecting element having a plurality of contacts for connection to a signal feed to said earphone, said connection element attached to said housing and having at least one additional contact connected to the microphone for use as an audio output.

* * * * *